US006500504B1

(12) United States Patent
Moucheron et al.

(10) Patent No.: US 6,500,504 B1
(45) Date of Patent: Dec. 31, 2002

(54) PORCELAIN FLOWER AND METHOD THEREFOR

(76) Inventors: Jill Moucheron, 214 Shannon Heights Dr., Verona, PA (US) 15147; Marilyn Babuscio, 214 Shannon Heights Dr., Verona, PA (US) 15147

( * ) Notice: Subject to any disclaimer, the term of this patent is extended or adjusted under 35 U.S.C. 154(b) by 0 days.

(21) Appl. No.: 09/997,457

(22) Filed: Nov. 29, 2001

(51) Int. Cl.[7] ..... A01N 3/00
(52) U.S. Cl. ..... 428/24; 428/25; 428/26; 428/15; 428/33; 428/6
(58) Field of Search ..... 428/24, 25, 26, 428/6, 15, 33

(56) References Cited

U.S. PATENT DOCUMENTS 4,324,821 A * 4/1982 Heineman, III

FOREIGN PATENT DOCUMENTS

JP 2001-003215 * 1/2001

* cited by examiner

*Primary Examiner*—Cynthia H. Kelly
*Assistant Examiner*—Tamra Dicus
(74) *Attorney, Agent, or Firm*—Rodgers & Rodgers

(57) ABSTRACT

A method of making a porcelain flower includes the steps of extending a wire through an apertured finding, twisting the free ends of the wire, forming an amount of porcelain compound into a flat sheet, cutting the shape of a flower petal out of the flat sheet, and wrapping the flower petal around the twisted wires.

4 Claims, 1 Drawing Sheet

PORCELAIN FLOWER AND METHOD THEREFOR

BACKGROUND OF THE INVENTION

Typically, wedding bouquets, corsages and boutonnieres are fashioned of live flowers which, while attractive when first made, have a short life span and eventually must be discarded. They also require extra care such as refrigeration.

On the other hand, porcelain flowers offer the advantage of permanency thereby allowing them to become wedding keepsakes as long as desired. Additionally, the weight of a porcelain flower is comparable to a conventional watered bouquet holder.

SUMMARY OF THE INVENTION

By this invention, a method of making a porcelain flower includes the steps of extending a wire through an apertured finding, twisting the free ends of the wire, forming an amount of porcelain compound into a flat sheet, cutting the shape of a flower petal out of the flat sheet, and wrapping the flower petal around the twisted wires.

The porcelain flower comprises an apertured finding with a wire extending therethrough and downwardly therefrom. The free ends of the wire are twisted and wrapped in floral tape to form a stem. Multiple planar flower petals are disposed in flat layered relation and secured to the stem.

DETAILED DESCRIPTION OF THE INVENTION

Figure 1:
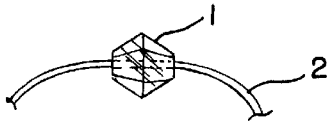
FIG. 1 depicts a wire extending through an apertured crystal.
Figure 2:
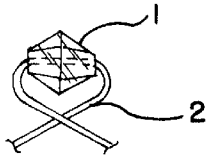
FIGS. 2 and 3 show twisting of the free ends of the wire.
Figure 3:
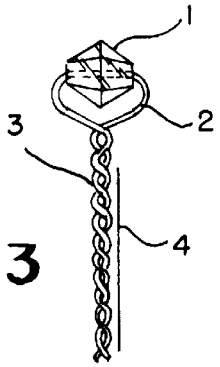
Figure 4:
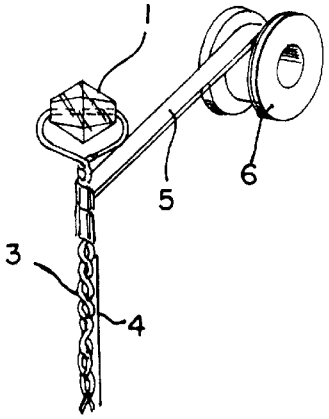
FIG. 4 shows tape being wrapped around the twisted wires.
Figure 5:
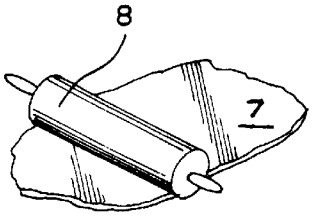
FIGS. 5, 6 and 7 include details of making the flower petal.

In the drawings, the numeral 1 designates a finding such as a crystal, bead, pearl, etc. with wire 2 extending therethrough. As shown in FIGS. 2 and 3, the free ends of wire 2 are twisted together along the full length thereof so as to form intertwined wire stem 3 as shown in FIG. 3. Then to provide added strength to stem 3, auxiliary wire 4 is placed along side twisted stem 3 of wire 2. Following this, floral tape 5 is dispensed from dispenser 6 and wrapped around stem 3 and auxiliary wire 4 as shown in FIG. 4.

Then an appropriate amount of porcelain compound is combined with lotion and manually kneaded until the compound becomes soft with a smooth consistency. The compound is then placed on a flat surface and rolled into a thin sheet 7 by means of rolling pin 8. The thickness of flat sheet 7 is variable depending on the particular type of flower desired.

Following this, the flower petal shape is cut out of flat sheet 7 by means of a floral cutter or cookie cutter-type of device. Of course, the shape of the petals is variable depending on the particular variety of the final flower.

Figure 6:
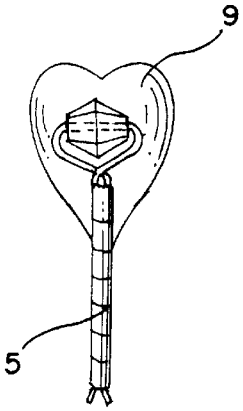
Figure 7:
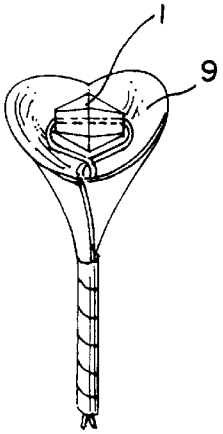
Figure 8:
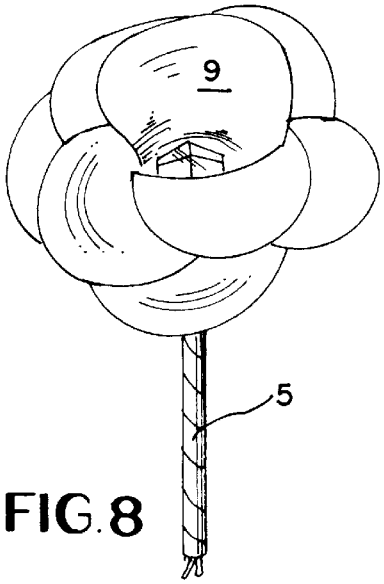
FIG. 8 is a view of a completed porcelain flower according to this invention.

Then the flat individual flower petals are placed under a moisture folder so as to maintain the proper moisture content. Following this, the flower petal is placed in one's palm and smoothed out by means of a ball tool such that the flower petal is given a curled, natural and textured appearance. Then flower petal 9 is simply wrapped around the upper portion of floral tape 5 as shown in FIG. 6. Flower petal 9 is then completely wrapped around and attached to stem 3, as shown in FIG. 7. The process is repeated with the number of flower petals added appropriate to the desired variety of flower.

The natural adhesion qualities of the porcelain compound causes petals 9 to attach to the adjacent petals. Therefore, by this invention, an economical and uncomplicated method of making porcelain flowers is achieved which is adaptable to a wide variety of flowers.

What is claimed is:

1. A porcelain flower comprising a finding, an aperture extending through said finding, a wire extending through said aperture and including free ends, said free ends being twisted to form a stem, a petal secured to said stem, and said finding comprising a crystal.

2. A porcelain flower according to claim 1 wherein an auxiliary wire is coextensive with said free ends and said auxiliary wire are said free ends are enveloped by floral tape.

3. A porcelain flower according to claim 1 wherein multiple petals are secured to said stem and are disposed in overlapping relation.

4. A porcelain flower comprising a finding, an aperture extending through said finding, a wire extending through said aperture and including free ends, said free ends being twisted to form a stem, a petal secured to said stem, and said finding comprising a pearl.

* * * * *